US005845651A

United States Patent [19]

de Nervo

[11] Patent Number: 5,845,651

[45] Date of Patent: Dec. 8, 1998

[54] DEVICE FOR PACKAGING AND APPLYING A HAIR-CARE PRODUCT

[75] Inventor: Stanislas de Nervo, Tokyo, Japan

[73] Assignee: L'Oreal, Paris, France

[21] Appl. No.: 824,517

[22] Filed: Mar. 26, 1997

[30] Foreign Application Priority Data

Apr. 3, 1996 [FR] France ..... 96 04188

[51] Int. Cl.[6] ..... A45D 24/22

[52] U.S. Cl. ..... 132/114; 220/266

[58] Field of Search ..... 132/113, 114, 132/115, 112; 220/265, 266, 278; 401/28

[56] References Cited

U.S. PATENT DOCUMENTS

| | | | |
|---|---|---|---|
| 2,392,195 | 1/1946 | Shonnard | 220/266 |
| 3,353,721 | 11/1967 | Love | 132/114 |
| 3,477,447 | 11/1969 | Eldredge . | |
| 3,570,499 | 3/1971 | Ruta . | |
| 3,591,053 | 7/1971 | Thomas . | |
| 3,858,739 | 1/1975 | Turner et al. | 220/266 |
| 4,183,328 | 1/1980 | Lawrence | 132/112 |
| 4,319,701 | 3/1982 | Cambio . | |
| 4,898,295 | 2/1990 | Kim | 220/266 |
| 5,361,947 | 11/1994 | Lifshey . | |

FOREIGN PATENT DOCUMENTS

| | | | |
|---|---|---|---|
| A-0-150-751 | 8/1985 | European Pat. Off. . | |
| A-1134371 | 4/1957 | France . | |
| A-1203209 | 1/1960 | France . | |
| A-25-57-476 | 6/1977 | Germany . | |
| 606843 | 7/1960 | Italy | 132/114 |
| A-2-206-567 | 1/1989 | United Kingdom . | |

*Primary Examiner*—Todd E. Manahan
*Attorney, Agent, or Firm*—Oliff & Berridge PLC

[57] ABSTRACT

The invention relates to a device for packaging and applying a liquid or semiliquid product, in particular for hair care, the device comprising a receptacle suitable for containing said product and an applicator in the form of a comb having hollow teeth for dispensing the product. The said applicator is fixed ab initio to the receptacle and the teeth of said applicator are closed prior to use in the case of one of the teeth by an individual snap-off portion and in the case of the other teeth by a common snap-off portion.

7 Claims, 2 Drawing Sheets

DEVICE FOR PACKAGING AND APPLYING A HAIR-CARE PRODUCT

The present invention relates to devices for packaging and applying a hair-care product that is liquid or semiliquid, in particular hair coloring or dye, and it relates more particularly to a device comprising a receptacle suitable for containing the product and an applicator in the form of a comb having hollow teeth for dispensing the product within the hair on the head.

BACKGROUND OF THE INVENTION

That type of device makes it possible to reduce the time required for application to the hair, and it makes it easier to obtain uniform coloring when the product is a dye.

American patent U.S. Pat No. 3,477,447 discloses an applicator in the form of a comb having hollow teeth for screwing onto the neck of a receptacle containing a dye.

The applicator as described in that American patent is nevertheless of relatively expensive structure and it is awkward to use if it is desired to perform a preliminary test.

It is then necessary to reclose the receptacle containing the dye in order to store it properly between the preliminary test and application to all of the hair, which may be performed on the following day, thereby making it necessary to unscrew the applicator and to screw a separate closure cap back onto the receptacle, which cap may become lost.

Also, it is difficult to extract from the receptacle only the small quantity required for a preliminary test.

OBJECTS AND SUMMARY OF THE INVENTION

The present invention provides a novel device for packaging and applying a liquid or semiliquid product, in particular for hair care, the device comprising a receptacle suitable for containing said product and an applicator in the form of a comb having hollow teeth for dispensing the product, wherein said applicator is fixed ab initio on the receptacle, and wherein one of its teeth is closed by an individual snap-off portion while its other teeth are closed by a common snap-off portion, said individual portion being shaped so that when turned upside-down it forms a closure cap for the corresponding tooth.

This tooth can thus be used to dispense a small quantity of product to perform a preliminary test.

The invention thus makes available a device which is easier to handle than prior art devices, and of low manufacturing cost, making it possible to envisage a device for single use only.

BRIEF DESCRIPTION OF THE DRAWINGS

Other characteristics and advantages of the present invention appear on reading the following detailed description of a non-limiting embodiment of the invention, and on examining the accompanying drawings, in which.

MORE DETAILED DESCRIPTION

Figure 1:
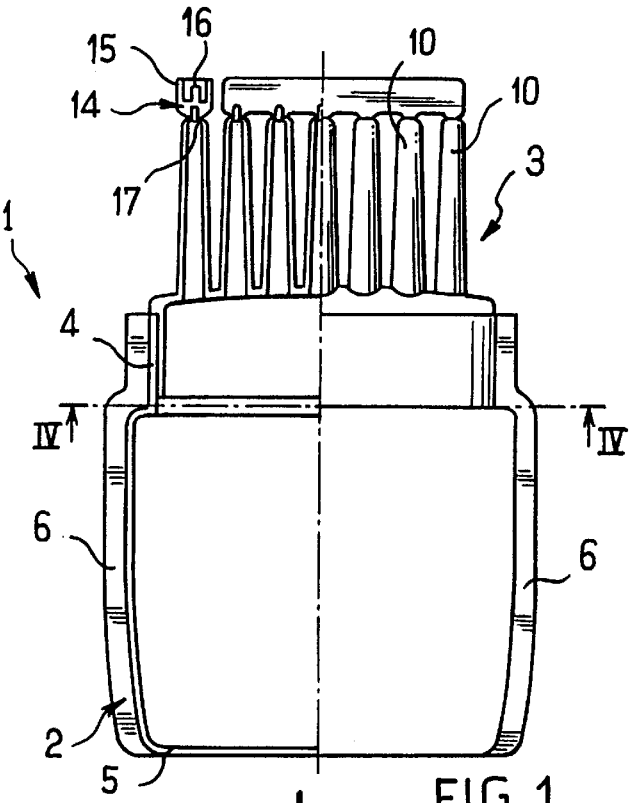
FIG. 1 is a partially cutaway front elevation view of a device constituting an embodiment of the invention.
Figure 3:
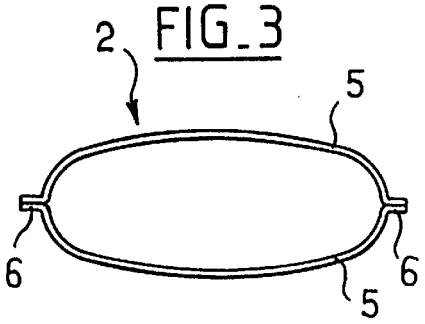
FIG. 3 is a view on section line III—III of FIG. 2.

FIG. 1 is a partially cutaway front elevation of a device 1 constituting an embodiment of the invention. It comprises a receptacle 2 suitable for containing a liquid product such as hair dye and an applicator 3 for dispensing the product in the hair of the head.

In the embodiment described, the receptacle 2 is constituted by assembling together two thermoformed shells 5, and at its top end it has a neck 4 defining an opening of oval section.

Each shell 5 has rims 6 at its side edges for being heat-sealed face to face with the corresponding rims of the other shell.

The shells 5 are preferably made of a relatively flexible plastics material, thereby enabling the product contained in the receptacle to be-expelled therefrom by using finger pressure.

The bottom edges of the two shells 5 are heat-sealed together directly edge-to-edge so as to constitute a flat bottom enabling the receptacle to stand upright.

Figure 2:
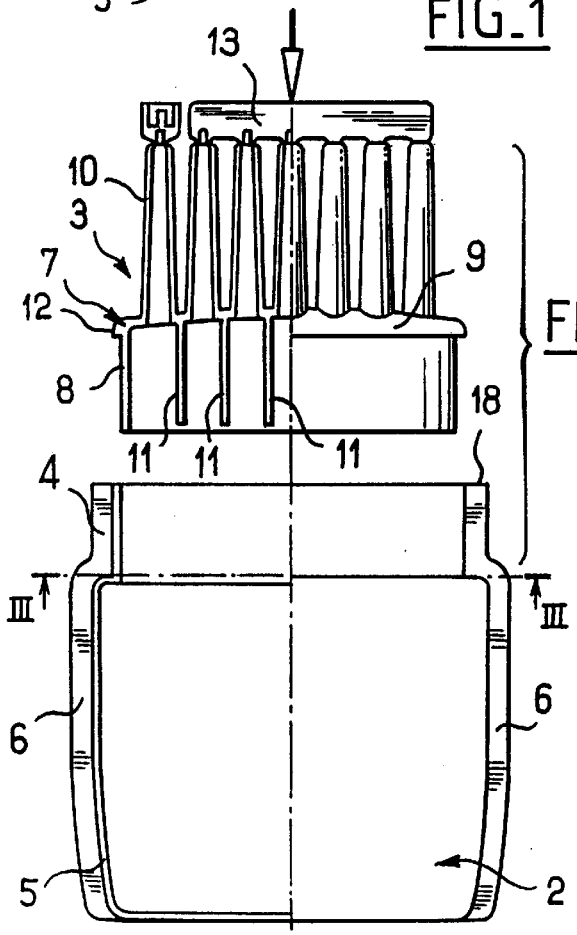
FIG. 2 is a view showing how the applicator is assembled on the receptacle.

The applicator 3 is preferably made by injection molding a flexible plastics material, and it comprises, as shown more particularly in FIG. 2, a base 7 constituted by a tubular skirt 8 of oval section that is closed at its top end by a wall 9 in the form of a dome, which wall has connected thereto a plurality of regularly spaced-apart parallel-axis hollow teeth 10.

The tubular skirt 8 is shaped to fit closely in the neck 4.

The base 7 is stiffened by a plurality of transverse partitions 11 extending across its width to interconnect the opposite sides of the tubular skirt 8, each partition also being connected to the top wall 9 between the bottom orifices of pairs of adjacent teeth 10 and extending over substantially the full height of the tubular skirt 8.

The periphery of the top wall 9 projects a little beyond the tubular skirt 8 so as to come into abutment against the top end edge of the neck 4 when the base 7 is inserted fully into the neck 4, as shown in FIG. 1.

The teeth 10 are conical in shape, tapering upwards. One of the two end teeth in the row of teeth, in particular the tooth on the left in the figures is closed by an individual snap-off portion 14 that is integrally molded with the remainder of the applicator 3. The other teeth 10 are closed at their top ends by a common snap-off portion 13 likewise integrally molded with the remainder of the applicator 3.

More particularly, the portion 13 is constituted by a vertical plate whose bottom edge interconnects the top ends of the teeth 10 by means of a thin wall which can be broken when a force is applied to the portion 13 in a direction perpendicular to its plane.

The thickness of the portion 13 is also hollowed out internally in line with the axial bore of each tooth 10 so that after the wall 14 has been broken, the top ends of the teeth 10 are thoroughly opened so as to allow the product contained in the receptacle 2 to flow out in satisfactory manner.

The top end of the portion 14 is constituted by a tubular wall 15 surrounding a central stud 16, and its bottom portion is connected to the conical wall of the tooth 10 via a thin annular wall for breaking to allow product to flow out through the tooth 10.

The bottom of the portion 14 is internally hollow in line with the central bore of the tooth 10 so that the outlet orifice thereof is thoroughly opened.

After separation, the portion 14 can be turned upside-down and engaged on the top end of the tooth 10, the stud 16 then engaging in the top orifice 17 of the tooth 10 while the tubular wall 15 is held by friction on the tooth 10.

Figure 4:
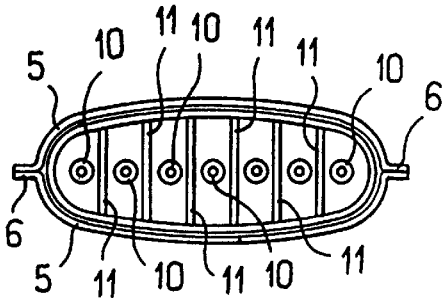
FIG. 4 is a views on section line IV—IV of FIG. 1.

After the receptacle 2 has been filled, the applicator 3 is inserted into the neck 4 until the top wall 9 comes into abutment against the top edge 18 of the neck 4 which then fits closely around the tubular skirt 8, as shown more particularly in the section of FIG. 4.

Figure 5:
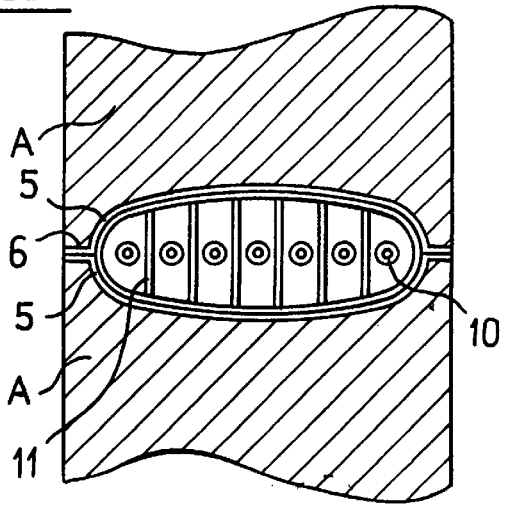
FIG. 5 is a diagram of a tool used for heat-sealing the applicator on the receptacle.

The neck 4 of the receptacle is then heat-sealed to the tubular skirt 8, e.g. by means of two heater jaws 4 that are pressed against the outside surface of the neck 4 of the receptacle, as shown diagrammatically in FIG. 5. The neck 4 is closed in leakproof manner by heat-sealing the applicator 3.

In a variant embodiment (not shown), the applicator is overmolded onto the neck of the receptacle.

In which case it is preferable for the receptacle to be fillable through its bottom, and for it to be constituted by a tube, for example.

Figure 6:
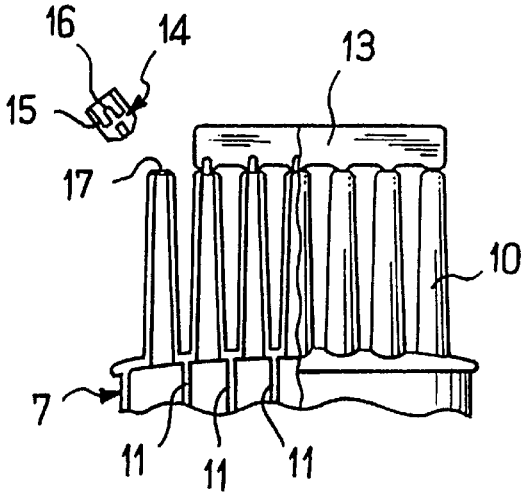
FIGS. 6 to 8 show various stages in the use of the device.

The applicator is used as follows. To make a preliminary trial, only the portion 14 is broken off, as shown in FIG. 6, thereby opening the orifice 17. This provides an endpiece that is suitable for dispensing a small quantity of product slowly, thereby enabling a preliminary test to be performed, e.g. the day before full treatment.

Figure 7:
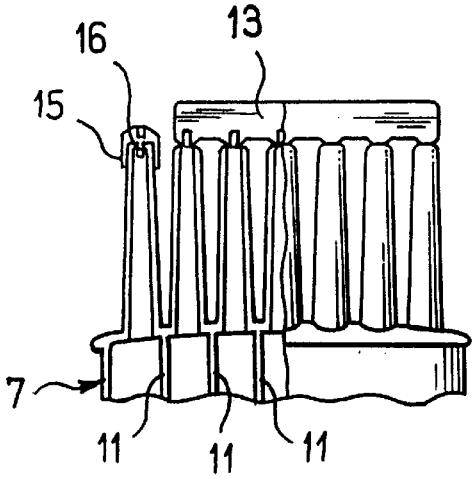

After a quantity of product suitable for performing the preliminary test has been dispensed, the portion 14 is turned upside-down to act as a closure cap for the corresponding tooth 10, as shown in FIG. 7.

Figure 8:
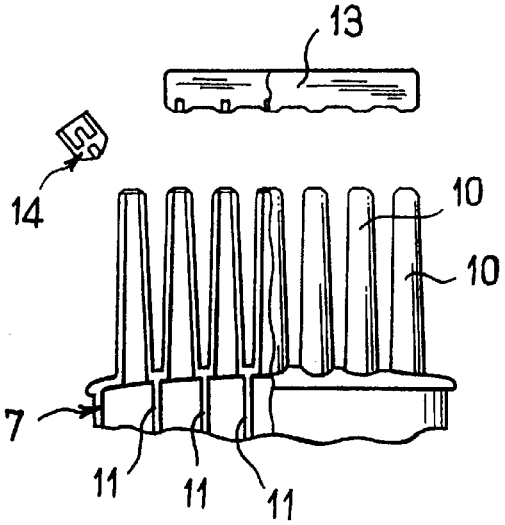

If the preliminary test is satisfactory, then the snap-off portion 13 is broken off, the portion 14 is removed again, and all of the teeth 10 are thus made available for dispensing the product, as shown in FIG. 8.

Naturally, the invention is not limited to the example described above and, without going beyond the ambit of the invention, it is possible to make the receptacle 2 by blow extrusion.

I claim:

1. A device for packaging and applying a liquid or semiliquid product for hair-care, the device comprising a receptacle suitable for containing said product and an applicator in the form of a comb having hollow teeth for dispensing the product, wherein said applicator is fixed ab initio on the receptacle, and wherein one of its teeth is closed by an individual snap-off portion while at least two of its other teeth are closed by a common snap-off portion, said individual portion being shaped so that when turned upside-down it forms a closure cap for the corresponding tooth.

2. A device according to claim 1, wherein the receptacle is made of two shells heat-sealed together around their periphery.

3. A device according to claim 1, wherein the receptacle has a neck of oval section in which the applicator is fixed.

4. A device according to claim 1, wherein the applicator is heat-sealed to a neck of the receptacle.

5. A device according to claim 1, wherein the applicator is overmolded on the neck of the receptacle.

6. A device according to claim 5, wherein the receptacle has closing means of its bottom.

7. A device according to claim 6, wherein the receptacle is a tube.

* * * * *